US005944418A

United States Patent [19]

Orr et al.

[11] Patent Number: 5,944,418

[45] Date of Patent: Aug. 31, 1999

[54] TANK STORAGE AND AGITATION SYSTEM

[75] Inventors: Alan Orr; Bernard J. Cook, both of Tulsa, Okla.

[73] Assignee: Helmerich & Payne International Drilling Company, Tulsa, Okla.

[21] Appl. No.: 09/007,874

[22] Filed: Jan. 15, 1998

[51] Int. Cl.[6] ..... B01F 7/16

[52] U.S. Cl. ..... 366/245; 366/347

[58] Field of Search ..... 366/262, 242, 366/244, 245, 247, 249, 250, 253, 254, 281, 282, 283, 284, 331, 347; 220/565, 203.01

[56] References Cited

U.S. PATENT DOCUMENTS

| | | | |
|---|---|---|---|
| 994,767 | 6/1911 | Mayer | 366/283 |
| 1,438,594 | 12/1922 | Goldberger | 366/282 |
| 2,450,107 | 9/1948 | Bostwick | 366/249 |
| 2,520,827 | 8/1950 | Beken | 366/262 |
| 2,557,622 | 6/1951 | Trier | 366/249 |
| 2,858,196 | 10/1958 | Ballard et al. | 366/247 |
| 3,149,888 | 9/1964 | Lennon | 366/331 |
| 4,252,268 | 2/1981 | Haire | 229/43 |
| 4,609,126 | 9/1986 | Janda | 220/374 |
| 4,911,834 | 3/1990 | Murphy | 210/167 |
| 5,102,803 | 4/1992 | Weaver | 366/281 |
| 5,129,469 | 7/1992 | Jackson | 175/66 |
| 5,132,025 | 7/1992 | Hays | 210/758 |
| 5,240,327 | 8/1993 | Nyman et al. | 366/262 |
| 5,399,014 | 3/1995 | Takata et al. | 366/262 |
| 5,425,466 | 6/1995 | Bambacigno | 220/203 |
| 5,611,619 | 3/1997 | Shen | 366/244 |

*Primary Examiner*—Tony G. Soohoo
*Attorney, Agent, or Firm*—Head, Johnson & Kachigian

[57] ABSTRACT

A tank system for storage and agitation of fluids. A tank includes cylindrical walls, a spherical bottom and an open top. A combined cover and walkway above the open top is parallel to the diameter of the cylindrical tank. A vent stack extending from the combined cover and walkway vents fumes from the cylindrical tank. A space is provided between the cover and the open top of the tank for fresh air intake.

18 Claims, 4 Drawing Sheets

46
3
46
27
22
42
24
26
18
46
10
3
46
28

30
32
40
34
2
2
20
16
12
36
26
14
10
42
46
46
18
28
22
24
48

TANK STORAGE AND AGITATION SYSTEM

BACKGROUND OF THE INVENTION

1. Field of the Invention

The present invention is directed to a tank system for storage and agitation or circulation of fluids. In particular, the present invention is directed to a tank system for storage of drilling fluids used in drilling wells. The present invention is directed to a tank system with maximum efficiency from mechanical agitators to produce a mixing action for chemicals and solid materials in suspension. The present invention also includes an innovative heat and fume removal system.

2. Prior Art

Mud tanks and mud tank systems are widely employed and known in the drilling, workover and mining industries. As an example, in the drilling industry, drilling may be performed for oil or gas wells or for water wells. In a typical process for a subterranean well bore, a bore is drilled into an earth formation.

Oftentimes, a drilling fluid is circulated from the surface, down through a drill string, and down to a drill bit. The drilling fluid absorbs heat generated by action of the drill bit. Thereafter, the drilling fluid passes up through an annular area to a return receptacle at the surface. The return drilling fluid carries with it earth particles and drill cuttings which are separated out in various ways at the surface, such as with a shale shaker. Other processing equipment, such as a degasser may also be used. After processing, the drilling fluid is then stored at the surface for reuse.

This drilling fluid or "mud" acts as a lubricant, a sealant to maintain downhole pressure, a coolant for the drill, and a hydraulic carrier of cuttings. The drilling fluid is retained in a mud tank and both stored for reinjection of the drilling fluid down through the drill stem. The storage tanks typically include a mechanism to agitate the fluids and keep the constituents from separating. The agitation of the fluids in the storage tank also serves to dissipate heat retained in the fluids.

Rectangular or square storage tank designs have traditionally been used for storage of drilling fluids. The fluids must be agitated throughout the tank during storage to avoid fluids from being stuck in a "dead" corner. Often a simple metal grate encloses the open top. Personnel are not shielded from the heat or fumes released from the drilling fluid.

At least two types of drilling mud are employed-water based mud and oil based mud, including synthetic variations. With oil based mud, it is desirable to keep the elements such as rain, snow or ice from mixing with the drilling fluid. At the same time, it is desirable during storage to ventilate the fluid to allow for cooling and discharge of fumes. The drilling mud may reach plus 180° F. after being circulated downhole.

It is, therefore, a principal object and purpose of the present invention to provide a tank system for storage and agitation of drilling fluid having a combined cover and walkway to protect the fluid from the elements and provide personnel with a platform.

It is also a principal object and purpose of the present invention to provide a tank system for storage and agitation of drilling fluid which will enhance the agitation of the fluid during storage and will provide a natural drainage system to allow drainage of said tank.

It is a further object and purpose of the present invention to provide a tank system for storage and agitation of drilling fluid having a heat and fume removal system.

SUMMARY OF THE INVENTION

The present invention is directed to a tank system used for storage and agitation of drilling fluid or drilling mud. The tank system includes a tank having cylindrical walls and a spherical bottom attached to the walls to form a container. At the opposite end of the tank from the bottom is an open top coincident with the diameter of the cylinder.

An opening is provided at the center of the spherical bottom, the opening being in fluid communication with outflow piping.

A combined cover and walkway is utilized channeling fumes and dissipating heat from the fluids stored in the cylindrical tank. The combined cover and walkway is parallel to the diameter of the tank and is above the open top. A space exists between the combined cover and walkway and the open top of the tank. A vent stack extends upward from the cover and is in communication with an opening through the cover. An agitator motor is mounted on the cover. Extending from the motor is an agitator shaft rotated by the motor. Extending radially outward from the agitator shaft is a plurality of impeller blades which serve to circulate and mix the fluids in the tank.

A vertical load support is utilized to support the tank. A plurality of tubular uprights are attached to the exterior of the cylindrical walls. Each of the tubular uprights is parallel to the tank axis. The tubular uprights are also used to support and space the combined cover and walkway. The base of the tubular uprights may be attached to a skid so that the entire tank system may be integral and moved to and from a desired drilling site.

In use, the fluid is continuously agitated/mixed in the storage tank by the plurality of impeller blades which are driven by the agitator shaft extending from the motor. Fresh air is directed into the tank through the space created by the tank open top and the combined cover and walkway. Heat is dissipated and fumes are vented from the fluid through a vent stack extending upward from the combined cover and walkway. When fluids in the tank are desired for use, they are removed from the tank through the bottom opening at the center of the spherical bottom.

DETAILED DESCRIPTION OF THE DRAWINGS

DETAILED DESCRIPTION OF THE PREFERRED EMBODIMENTS

Figure 1:
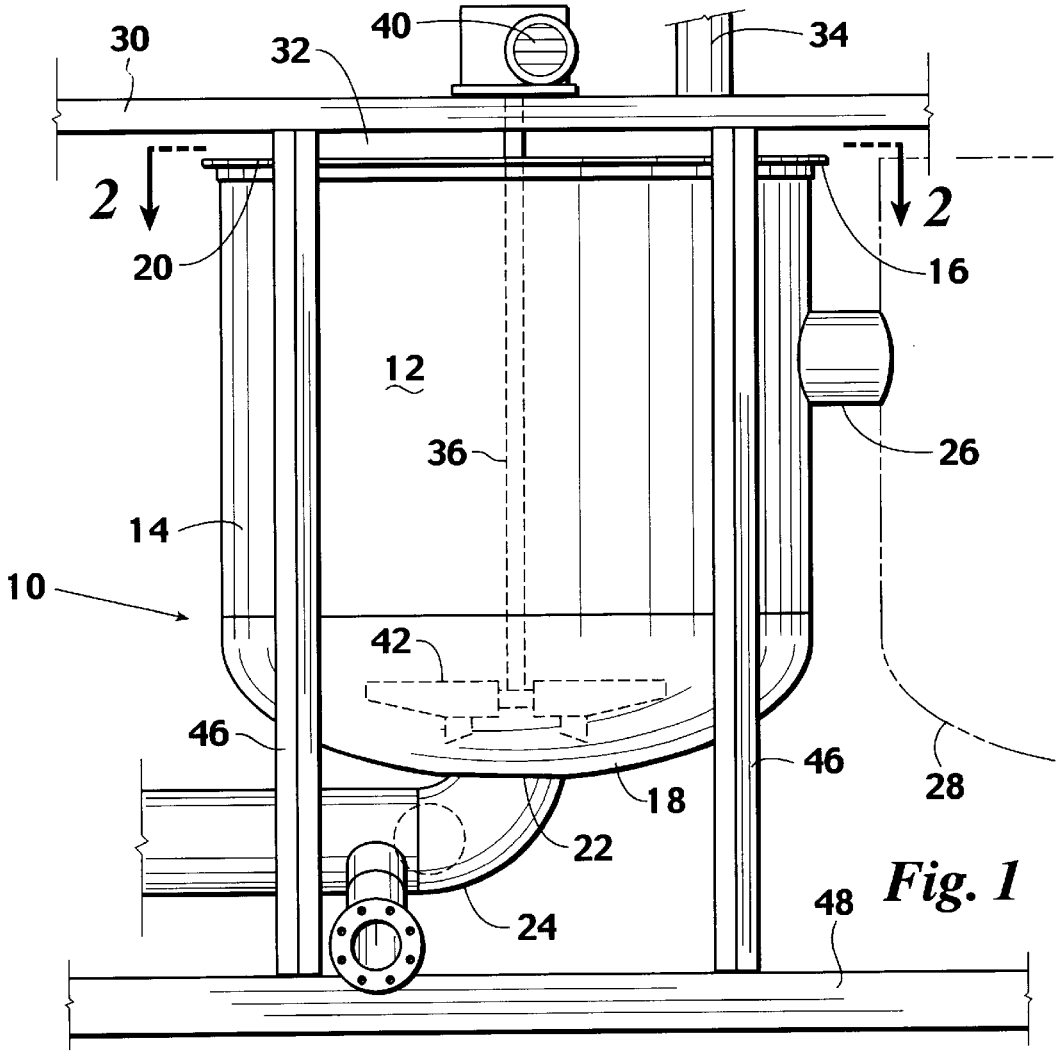
FIG. 1 is a plan view of a tank storage and agitation system constructed in accordance with the present invention.

Referring to the drawings in detail, FIG. 1 illustrates a tank system 10 which is used for storage and circulation of drilling fluid or drilling mud constructed in accordance with the present invention. The tank system 10 includes a tank 12 having cylindrical walls 14 with an axis which is perpendicular to ground level (not seen in FIG. 1). The tank 12 also includes a spherical bottom 18 attached to the cylindrical walls 14. The cylindrical walls 14 and spherical bottom 18 together form a container. At the opposite end of the tank 12 from the bottom 18 is an open top 20, which is coincident with the diameter of the cylinder. The open top 20 terminates in a lip 16 to provide rigidity to the top.

Figure 2:
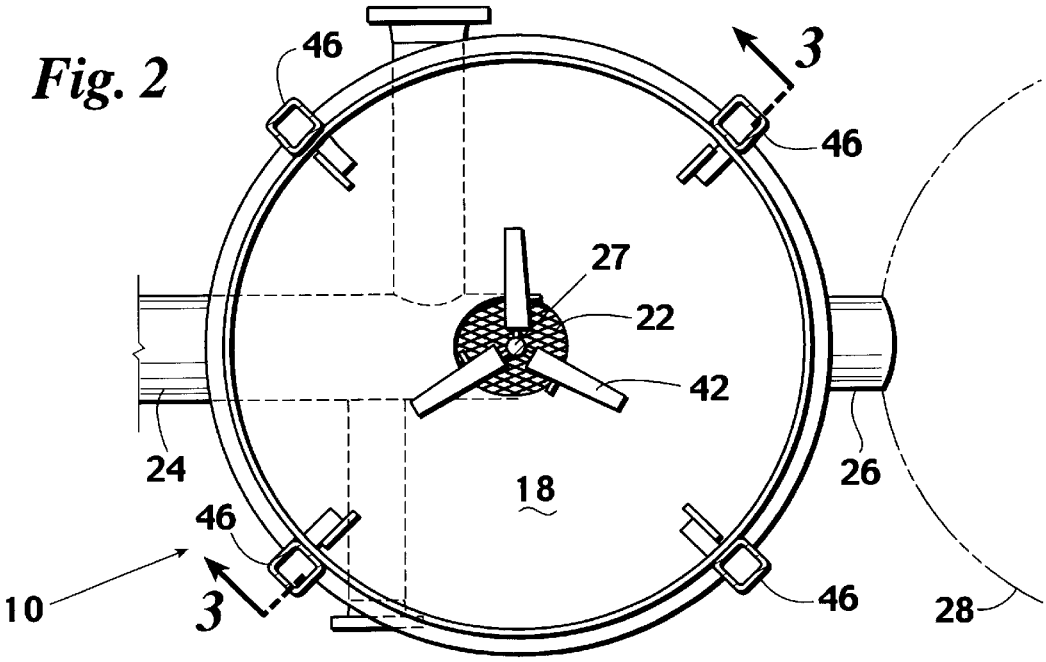
FIG. 2 is a sectional view taken along section line 2—2 of FIG. 1.

FIG. 2 is a sectional view taken along section line 2—2 of FIG. 1, so that the interior of the tank 12 is visible. As best seen in FIG. 2, an opening 22 is provided at the center of the spherical bottom 18. The spherical bottom opening 22 is in fluid communication with outflow piping 24. Because of the present design, there is a natural drainage of fluids in the tank toward the bottom opening 18. A screen 27 may cover the bottom opening to trap any large objects in the tank 12.

The outflow piping 24 may be in communication with a pump to assist in moving drilling fluid. The drilling fluid (not shown) will be moved through the outflow piping 24 to be used, such as delivered down a drill string. After use, the drilling fluid may be processed and then returned to the tank 12 through inflow 26.

Figure 4:
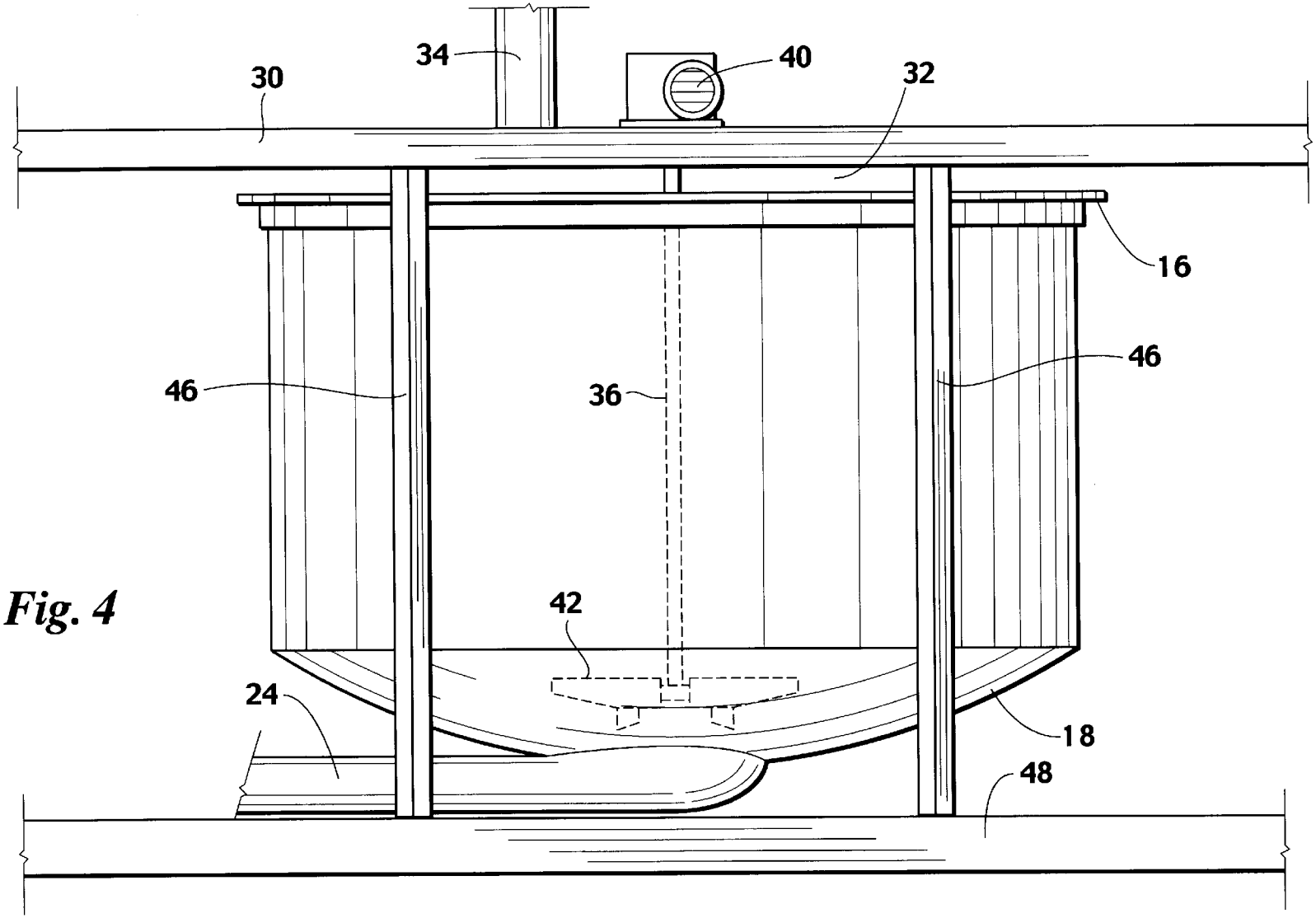
FIG. 4 is a side view of the tank storage system.
Figure 5:
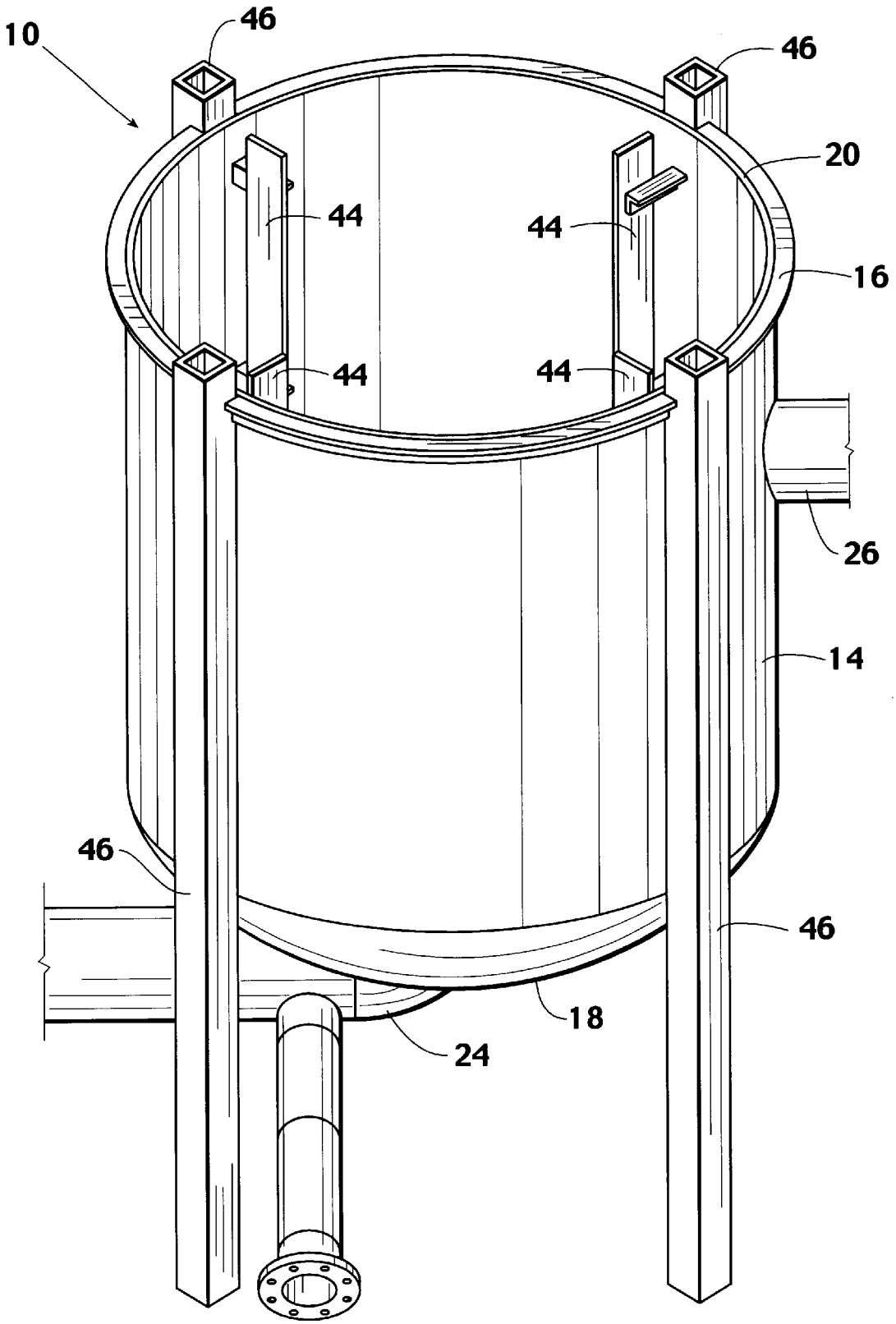
FIG. 5 is a perspective view of the tank system with the combined cover and walkway removed for ease of comprehension.

A combined cover and walkway 30 is utilized for venting fumes and for dissipating heat from the fluids in the cylindrical tank 12. The combined cover and walkway 30 is parallel to the diameter of the cylindrical tank 12 and is near the open top 20. As seen in FIGS. 1, 2 and 4, the combined cover and walkway 30 may be extended to cover additional tanks, such as tank 28 (in dashed lines) in FIG. 1. Accordingly, a single cover 30 would be employed for multiple tanks. With this arrangement, a modular design may be employed.

An annular space 32 exists between the combined cover and walkway 30 and the open top of the tank 12. By spacing the cover from the open top, the cover remains relatively cool for personnel walking thereon. Since the cover is a solid sheet, no elements such as rain or snow can enter the tank. As seen in FIGS. 1 and 4, a vent stack 34 extends upward from an opening in the cover 30.

Fumes and heat will rise upward from fluids in the tank 12 and enter the vent stack 34 and rise upward. The fumes will exit from the upper end of the vent stack 34. In the present embodiment, the vent stack 34 will extend to a level above the height of personnel. Accordingly, the fumes will be vented above the level of any personnel on the walkway.

With reference to FIGS. 1 and 4, a motor 40 is mounted on the top of the cover 30. Various types of motors might be employed, such as an electric motor. Extending from the motor 40 is an agitator shaft 36 which passes through the cover and is rotated by the motor. The agitator shaft 36 lies generally along the axis of the cylindrical tank. Extending radially outward from the agitator shaft 36 is a plurality of impeller blades 42.

The impeller blades 42 serve to circulate and mix the fluids in the storage tank 12. The action of the impeller blades 42 will cause the fluid to rotate in a circular fashion. The action of the impeller blades will also cause the fluids to move downward in the tank and contact the spherical bottom. Thereafter, the mud will move radially outward along the bottom until it reaches the cylindrical wall of the tank. The mud will then migrate upward toward the open top.

Figure 3:
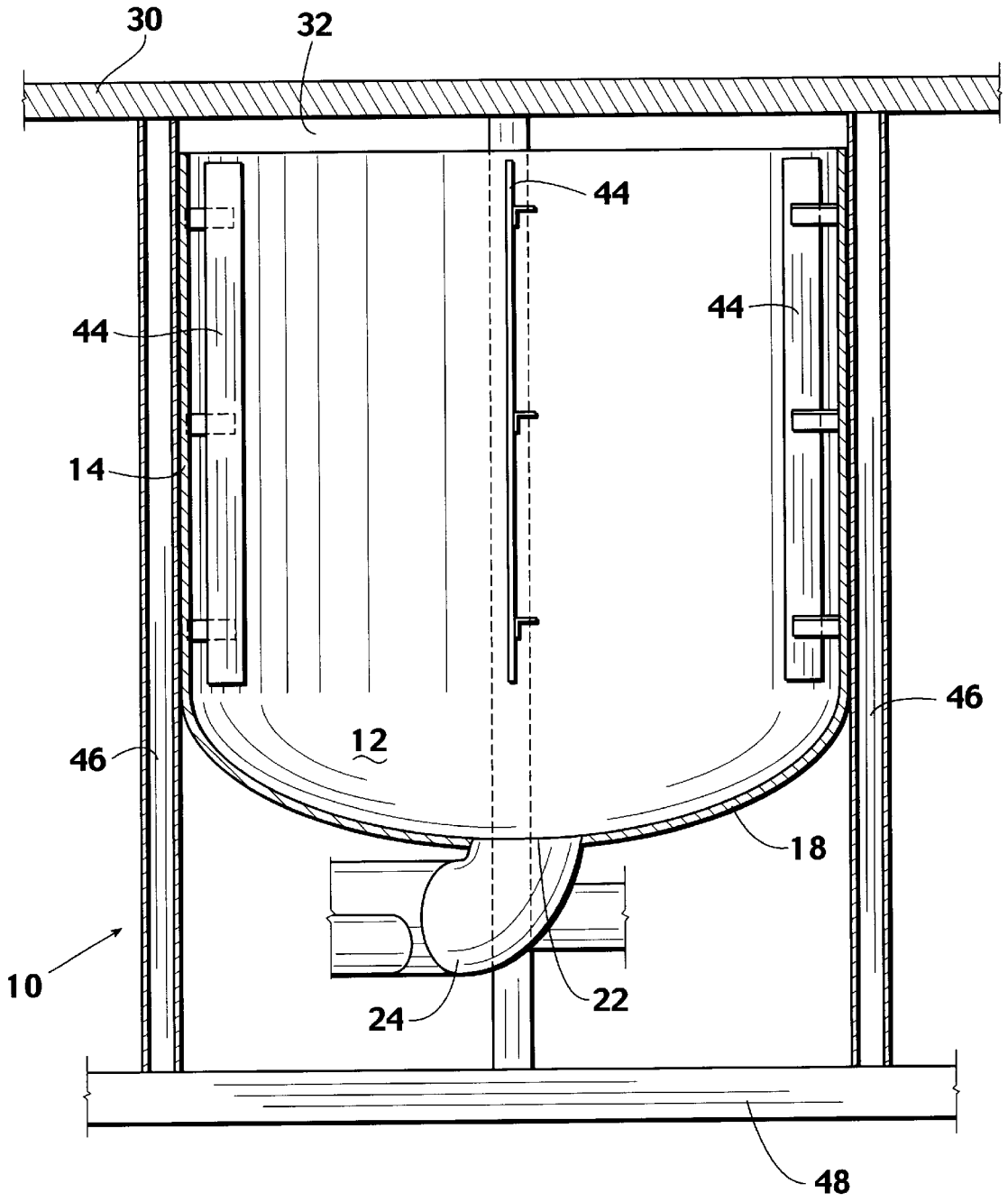
FIG. 3 is a sectional view taken along section line 3—3 of FIG. 2.

FIG. 3 is a sectional view taken along section line 3—3 of FIG. 2 with the agitator shaft and impeller blades removed for clarity. The mud circulating in the tank 12 will also engage a plurality of baffle plates 44 causing a further mixture of the fluids in the tank and preventing the volume of mud from rotating in the direction of the mixer blade rotation. The baffle plates extend from the interior of the cylindrical tank radially toward the axis.

A vertical load support may be used as a part of the system to support and mount the tank 12 and cover. A plurality of tubular uprights 46 are attached to the exterior of the cylindrical walls. Each of the tubular uprights 46 is parallel to the tank axis. The tubular uprights 46 are used to support and space the combined cover and walkway. One end of each tubular upright 46 is connected to the cover 30 while the other end is connected to a skid. Accordingly, the entire mud system may be integral and may be brought to a desired drilling site.

To utilize the tank storage and agitation system, a fluid is inserted or directed into the tank 12 through intake 26. The intake 26 may be connected to an adjacent, additional tank 28 so that a series of tanks are interconnected. The fluid is continuously circulated in the storage tank 12 by the agitator shaft extending from the motor which extends along the axis of the tank. The impeller blades 42 extending radially from the shaft 36 circulate the fluid within the tank 12. Fresh air is directed into the tank through the annular space 32 created by the tank open top 20 and the combined cover and walkway 30. Heat is dissipated and the fumes are vented from the fluid through the vent stack 34 extending upward from the combined cover and walkway 30. The fumes are exhausted above the level of personnel on the combined cover and walkway. When fluids in the tank are desired for use, the fluids are removed from the tank 12 through a bottom opening 22 at the center of the spherical bottom which is in communication with the outflow piping.

Whereas, the present invention has been described in relation to the drawings attached hereto, it should be understood that other and further modifications, apart from those shown or suggested herein, may be made within the spirit and scope of this invention.

What is claimed is:

1. A tank system for storage and agitation of fluids, which system comprises:

a tank having cylindrical walls, a spherical bottom, and an open top;

a combined cover and walkway above said open top parallel to the diameter of said cylindrical tank; and a space between said cover and said open top of said tank.

2. A tank system as set forth in claim 1 including an opening at the center of said spherical bottom to allow fluid flow from said opening.

3. A tank system as set forth in claim 2 wherein said spherical bottom opening is in fluid communication with outflow piping.

4. A tank system as set forth in claim 1 including a vent stack extending from said combined cover and walkway for venting of fumes from said fluids in said cylindrical tank.

5. A tank system as set forth in claim 4 wherein said vent stack extends a height above the level of personnel standing on said cover and walkway.

6. A tank system as set forth in claim 1 including a motor, an agitator shaft extending from said motor into said cylindrical tank along the axis of said cylindrical tank, and impeller blades extending from said agitator shaft to mix said fluids.

7. A tank system as set forth in claim 6 wherein said motor is mounted on said combined cover and walkway.

8. A tank system as set forth in claim 1 wherein said cylindrical tank and said combined cover and walkway are both mounted on a vertical load support system.

9. A tank system as set forth in claim 8 wherein said vertical load support system includes a plurality of tubular uprights attached to said cylindrical walls and parallel to said tank axis.

10. A tank system as set forth in claim 9 wherein each said tubular upright has a first end connected to said combined cover and walkway and a second end connected to a skid structure.

11. A tank system as set forth in claim 10 including at least one additional tank having cylindrical walls, a spherical bottom, and an open top so that said combined cover and walkway extends over both said tanks.

12. A tank system as set forth in claim 1 including a plurality baffle plates extending from said cylindrical walls inward toward said tank axis.

13. A method to store and agitate fluids, which method comprises:

inserting a fluid into a tank having cylindrical walls, a spherical bottom and an open top;

agitating said fluid in said tank with a motor having a shaft extending along the axis of said tank and a plurality of impeller blades extending radially from said shaft;

directing fresh air into said tank through an annular space created by said tank open top and a combined cover and walkway above said open top parallel to the diameter of said tank; and venting fumes from said fluid through a vent stack extending from said combined cover and walkway.

14. A method to store and agitate fluids as set forth in claim 13 including the additional step of removing fluids from said tank through an opening at the center of said spherical bottom in communication with outflow piping.

15. A method to store and agitate fluids as set forth in claim 13 including the additional step of mounting said motor on said cover and walkway.

16. A method to store and agitate fluids as set forth in claim 13 wherein said fluid is moved toward said spherical bottom, radially outward along said spherical bottom and axially along said cylindrical walls.

17. A tank system for storage and agitation of fluids, which system comprises:

a tank having cylindrical walls, a spherical bottom and an open top;

a combined cover and walkway above said open top parallel to the diameter of said cylindrical tank; and a motor mounted on said combined cover and walkway, said motor including an agitator shaft extending into said cylindrical tank along the axis of said tank and impeller blades extending from said agitator shaft in order to mix said fluids.

18. A tank system as set forth in claim 17 including an opening at the center of said spherical bottom to allow fluid flow from said opening.

* * * * *